US008506261B2

(12) United States Patent
Taguchi

(10) Patent No.: US 8,506,261 B2
(45) Date of Patent: Aug. 13, 2013

(54) DISPLACEMENT CONTROL SYSTEM FOR VARIABLE DISPLACEMENT COMPRESSOR

(75) Inventor: Yukihiko Taguchi, Maebashi (JP)

(73) Assignee: Sanden Corporation, Gunma (JP)

( * ) Notice: Subject to any disclaimer, the term of this patent is extended or adjusted under 35 U.S.C. 154(b) by 268 days.

(21) Appl. No.: 12/995,176

(22) PCT Filed: May 26, 2009

(86) PCT No.: PCT/JP2009/059563

§ 371 (c)(1),
(2), (4) Date: Nov. 29, 2010

(87) PCT Pub. No.: WO2009/145163

PCT Pub. Date: Dec. 3, 2009

(65) Prior Publication Data

US 2011/0076161 A1 Mar. 31, 2011

(30) Foreign Application Priority Data

May 28, 2008 (JP) ..... 2008-139480

(51) Int. Cl.
*F04B 1/26* (2006.01)

(52) U.S. Cl.
USPC ..... 417/222.2; 417/222.1

(58) Field of Classification Search
USPC ..... 417/222.1, 222.2
See application file for complete search history.

(56) References Cited

U.S. PATENT DOCUMENTS 6,196,808 B1 * 3/2001 Taguchi ..... 417/222.2
2006/0275145 A1 * 12/2006 Takahashi et al. ..... 417/222.2

FOREIGN PATENT DOCUMENTS

| | | |
|---|---|---|
| JP | 9-324763 | 12/1997 |
| JP | 2002-285973 | 10/2002 |
| JP | 2003-343432 | 12/2003 |
| JP | 2004-293515 | 10/2004 |
| JP | 2005-133687 | 5/2005 |
| JP | 2006-342718 | 12/2006 |
| JP | 2008-25553 | 2/2008 |

* cited by examiner

*Primary Examiner* — Charles Freay
*Assistant Examiner* — Patrick Hamo
(74) *Attorney, Agent, or Firm* — Cozen O'Connor

(57) ABSTRACT

A displacement control system (B) for a variable displacement compressor has an electromagnetic clutch (200), a displacement control valve (300) including a valve body (306) that is applied with pressure of a suction pressure region of a variable displacement compressor (100) and an electromagnetic force of a solenoid unit in an opposite direction to the pressure of a discharge pressure region, and biasing means that biases the valve body (306) in the same direction as the electromagnetic force, and means (453, 454, 405) for adjusting current, which adjusts current supplied to a displacement control valve coil (316) according to external information detected by external-information detecting means (403, 451, 452).

7 Claims, 9 Drawing Sheets

DISPLACEMENT CONTROL SYSTEM FOR VARIABLE DISPLACEMENT COMPRESSOR

This is a U.S. National Phase under 35 U.S.C. §371 of International Application No. PCT/JP2009/059563, filed on May 29, 2009 and claims priority on Japanese Patent Application No. 2008-139480, filed on May 28, 2008, the entire content of which is hereby incorporated by reference.

TECHNICAL FIELD

The present invention relates to a displacement control system for a variable displacement compressor, which is applied to a refrigeration cycle of an air-conditioning system.

BACKGROUND ART

A variable displacement compressor is used, for example, in a vehicle air-conditioning system. The displacement control of the variable displacement compressor is carried out by opening/closing a displacement control electromagnetic valve.

For example, in the case of the displacement control device using a displacement control electromagnetic valve shown in FIG. 2 of Patent Document 1, current (control current I) supplied to an electromagnetic coil of a solenoid unit is adjusted so that difference between pressure of a discharge chamber of a compressor (discharge pressure Pd) and pressure of a suction chamber (suction pressure Ps) (Pd−Ps differential pressure) becomes a given value.

The displacement control electromagnetic valve has a first compression coil spring that biases a valve body in a valve-opening direction and a second compression coil spring that biases the valve body in a valve-closing direction. The first compression coil spring has a larger biasing force than the second compression coil spring. For that reason, when the control current I is zero, the displacement control electromagnetic valve is in an open position, and discharge displacement is maintained at minimum.

PRIOR ART DOCUMENT

Patent Document

Patent Document 1: Japanese Patent Kokai Publication No. 2002-285973

DISCLOSURE OF THE INVENTION

Problem to be Solved by the Invention

The displacement control electromagnetic valve shown in FIG. 2 of Patent Document 1 has performance characteristic expressed by Formula (1) below. Formula (2) is yielded by modifying Formula (1). In these formulae, Sv1 represents area in which the valve body receives discharge pressure Pd and suction pressure Ps (pressure-receiving area); f1 is a biasing force of a first compression coil spring; f2 is a biasing force of a second compression coil spring; and F(I) is an electromagnetic force of a solenoid unit.

Formula (2) is modified into Formula (3) by designing the solenoid unit so that the electromagnetic force F(I) is proportional to control current I. A in Formula (3) is a proportionality constant. Formula (3) represented by a graph appears as shown by a straight line A of FIG. 4.

$$Sv1 \cdot (Pd - Ps) + f1 - f2 - F(I) = 0 \quad (1)$$

$$Pd - Ps = \frac{1}{Sv1} \cdot F(I) + \frac{f1 - f2}{Sv1} \quad (2)$$

$$Pd - Ps = \frac{A}{Sv1} \cdot I - \frac{f1 - f2}{Sv1} \quad (3)$$

If a value of the control current I, at which Pd−Ps differential pressure reaches zero when the control current I is reduced by degree, is a lower limit Imin, Imin=(f1−f2)/A is true according to Formula (3). The biasing forces f1 and f2 of the first and second compression coil springs are set so that f1>f2 is true. As a result, Imin>0 is true. When the control current I is within a range from zero to the lower limit Imin, the displacement control electromagnetic valve is in an open position.

In order to control discharge displacement by adjusting the Pd−Ps differential pressure, therefore, the control current I needs to be made higher than the lower limit Imin. On this account, when the control current I is within a range from zero to the lower limit Imin, the control current I is wastefully consumed, and the electromagnetic force F(I) of the solenoid unit is not effectively used.

The above problem is caused by the fact that the biasing force f1 acting in a valve-opening direction is greater than the biasing force f2 acting in a valve-closing direction, and that the biasing force f1 acts upon the valve body in an opposite direction to the electromagnetic force F(I) of the solenoid unit.

According to conventional technology, if the value of the control current I, at which the Pd−Ps differential pressure reaches a maximum value (maximum differential pressure ΔPmax), is an upper limit Imax, this means that the Pd−Ps differential pressure changes from zero to the maximum differential pressure ΔPmax while the control current I changes from the lower limit Imin to the upper limit Imax. A change rate of the Pd−Ps differential pressure to the control current I at this time point is higher than that in the case where the Pd−Ps differential pressure changes from zero to the maximum differential pressure ΔPmax while the control current I changes from zero to the upper limit Imax.

On this account, under the conventional technology, the Pd−Ps differential pressure is easily fluctuated by a slight fluctuation of the control current I, and discharge displacement control is prone to be unstable.

The invention has been made in light of the above-mentioned circumstances. It is an object of the invention to provide a displacement control system for a variable displacement compressor, which effectively uses the electromagnetic force of a solenoid unit of a displacement control valve and shows excellent stability in displacement control.

Means for Solving the Problem

In order to accomplish the above-mentioned object, according to the invention, a displacement control system for a variable displacement compressor, which is interposed in a circulation path circulating a refrigerant therethrough together with a radiator, an expansion device, and an evaporator to configure a refrigeration cycle, and changes displacement according to a change in control pressure. The displacement control system has an electromagnetic clutch that includes a coil and connects between the compressor and a power source when the coil is supplied with current; a displacement control valve including a valve body that is applied with pressure of a discharge pressure region of the variable displacement compressor and applied with pressure of a suction pressure region of the variable displacement compressor and an electromagnetic force of a solenoid unit in an opposite direction to the pressure of the discharge pressure region, and biasing means that biases the valve body in the same direction as the electromagnetic force, and changes the control pressure by operating the valve body; external-information detecting means for detecting at least one piece of external information; means for adjusting current for an electromagnetic clutch, which adjusts current supplied to the coil of the electromagnetic clutch according to the external information detected by the external-information detecting means; and means for adjusting current for the displacement control valve, which adjusts current supplied to a coil of the solenoid unit according to the external information detected by the external-information detecting means (claim 1).

Preferably, when current is supplied to the coil of the electromagnetic clutch and not to the coil of the solenoid unit of the displacement control valve, discharge displacement of the variable displacement compressor is greater than minimum discharge displacement of the variable displacement compressor, which is mechanically defined (claim 2).

Preferably, when the current supply to the coil of the electromagnetic clutch and to the coil of the solenoid unit of the displacement control valve is started, current is supplied to the coil of the solenoid unit of the displacement control valve after being supplied to the coil of the electromagnetic clutch (claim 3).

Preferably, the current supplied to the coil of the solenoid unit of the displacement control valve is gradually increased from a time point when the current supply is started (claim 4).

Preferably, the external-information detecting means includes discharge-pressure detecting means that detects the pressure of the discharge pressure region. The means for adjusting current for the displacement control valve includes means for setting target suction pressure, which sets target suction pressure that is a target value of the pressure of the suction pressure region on the basis of the external information detected by the external-information detecting means, and adjusts current supplied to the coil according to the pressure of the discharge pressure region, which is detected by the discharge-pressure detecting means, and the target suction pressure that is set by the means for setting target suction pressure (claim 5).

Preferably, the means for adjusting current for the displacement control valve includes means for setting target differential pressure, which sets a target value of difference between the pressure of the discharge pressure region and the pressure of the suction pressure region on the basis of the external information detected by the external-information detecting means, and adjusts current supplied to a solenoid according to the target differential pressure that is set by the means for setting target differential pressure (claim 6).

Preferably, the variable displacement compressor has a housing that is sectioned into the discharge pressure region, a crank chamber, the suction pressure region and a cylinder bore; a piston that is disposed in the cylinder bore; a drive shaft that is rotatably supported within the housing; a conversion mechanism including a tiltable swash plate element that converts the rotation of the drive shaft into a reciprocating motion of the piston; a gas passage that connects the discharge chamber and the crank chamber to each other; and a gas release passage that connects the crank chamber and the suction chamber to each other. The displacement control valve is interposed in the gas passage (claim 7).

Advantages of the Invention

With the displacement control system for a variable displacement compressor according to the invention, if current (control current) is supplied to the coil of the solenoid unit even by a small amount, an electromagnetic force is produced in the solenoid unit. By using this electromagnetic force, the difference between the pressure of the discharge pressure region (discharge pressure Pd) and the pressure of the suction pressure region (suction pressure Ps) (Pd−Ps differential pressure) is adjusted. Consequently, even a small amount of control current is not consumed wastefully and is effectively used for the displacement control (claim 1).

The control current is effectively used for the displacement control in a range from the vicinity of zero to the maximum value, and this lowers a ratio of change amount of the Pd−Ps differential pressure to change amount of the control current, and also reduces dispersion of the Pd−Ps differential pressure when the control current is adjusted. As a consequence, the stability of the displacement control is enhanced (claim 1).

Since the control current is effectively used for the displacement control in a range from the vicinity of zero to the maximum value, it is possible to increase area (pressure-receiving area) in which the valve body receives the discharge pressure Pd and the suction pressure Ps. This improves the performance sensitivity of the valve body toward a change of the Pd−Ps differential pressure, and enhances the stability of the displacement control (claim 1).

The refrigerant is securely circulated through the circulation path even when no current is supplied to the coil of the solenoid unit of the displacement control valve. Even if the control current supplied to the coil is reduced by degree, the refrigerant circulation never stops suddenly. With the displacement control system, therefore, the displacement control is stabilized even when the control current is in the vicinity of the minimum value (claim 2).

When the compressor and the power source are connected together by means of an electromagnetic clutch, no current is supplied to the coil of the solenoid unit of the displacement control valve. The compressor is then activated by small discharge displacement. As a result, an activation load of the compressor is small, which improves the credibility of the compressor and of the electromagnetic clutch (claim 3).

If the small discharge displacement is gradually increased, this prevents a sharp rise in the discharge pressure and an abrupt increase in drive load of the compressor. With the displacement control system, the discharge displacement is smoothly controlled for a time period from the activation of the compressor to the beginning of normal driving of the compressor (claim 4).

Due to the adjustment of the current supplied to the coil of the solenoid unit of the displacement control valve according to the discharge pressure and the target suction pressure, a control range of the discharge displacement is wide. On that basis, the control current is effectively used for the displacement control in a range from the vicinity of zero to the maximum value, so that the entire region of the wide control range is used with effect (claim 5).

Since the current supplied to the coil is adjusted according to the target differential pressure that is the target value of the Pd−Ps differential pressure, the control range of the discharge displacement is wide. On that basis, the control current is effectively used for the displacement control in a range from the vicinity of zero to the maximum value, so that the entire region of the wide control range is used with effect (claim 6).

The variable displacement compressor is of a reciprocating type including a swash plate element. A mechanical variable range of the discharge displacement is wide, and the wide variable range is effectively used (claim 7).

BEST MODE OF CARRYING OUT THE INVENTION

Figure 1:
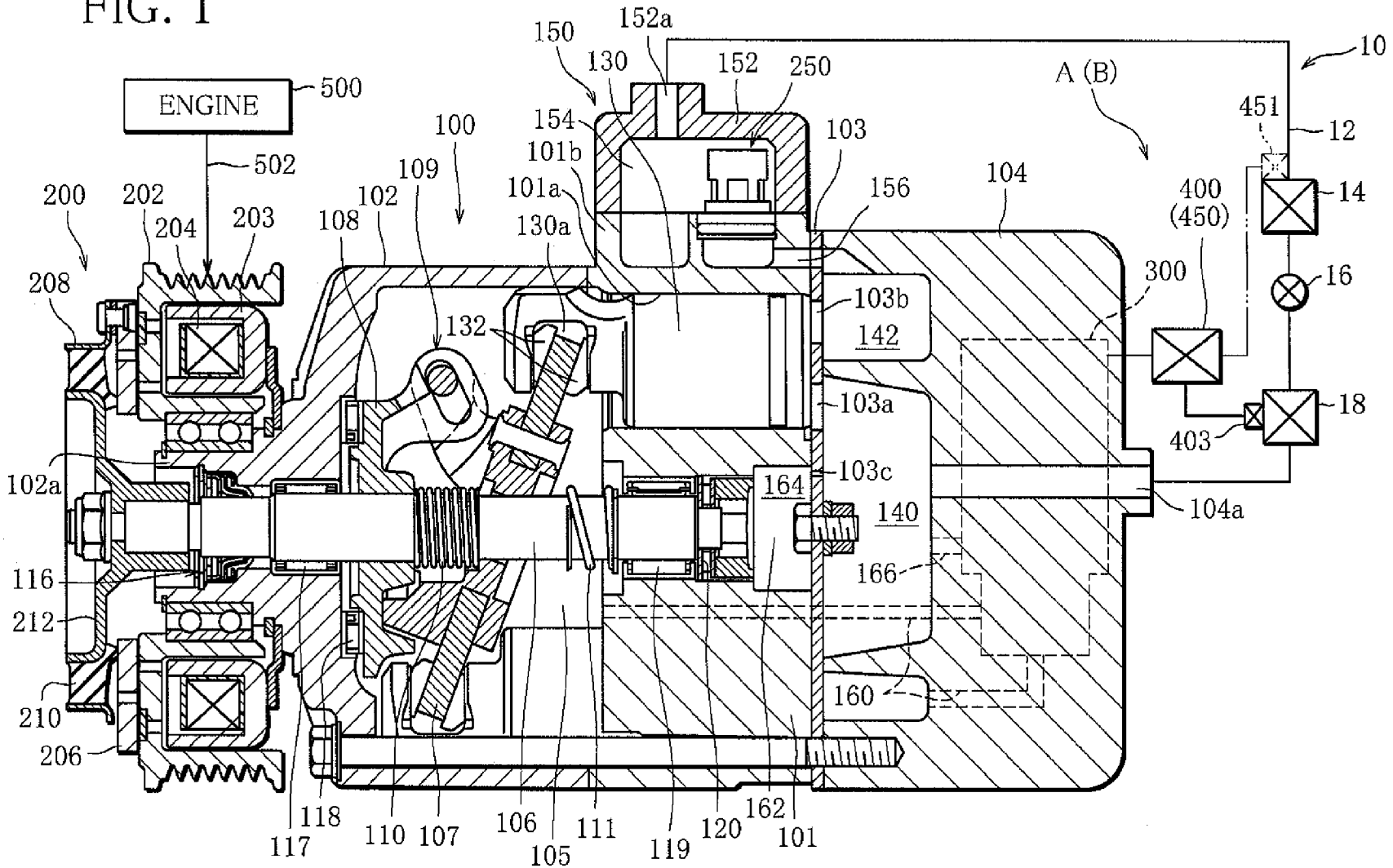
FIG. 1 is a view showing a schematic configuration of a refrigeration cycle of a vehicle air-conditioning system together with a longitudinal sectional view of a variable displacement compressor.

FIG. 1 shows a refrigeration cycle (refrigeration circuit) 10 of a vehicle air-conditioning system. The refrigeration cycle 10 includes a circulation path (external circulation path) 12 through which a refrigerant serving as working fluid is circulated. A compressor 100, a radiator (condenser) 14, an expansion device (expansion valve) 16 and an evaporator 18 are interposed in the circulation path 12 in the order as viewed in a refrigerant-flowing direction. When the compressor 100 is operated, the refrigerant circulates through the circulation path 12. That is to say, the compressor 100 carries out a series of processes including the step of sucking in the refrigerant, the step of compressing a sucked-in refrigerant, and the step of discharging a compressed refrigerant.

The evaporator 18 forms a part of an air circuit of the vehicle air-conditioning system. An air flow that passes through the evaporator 18 is refrigerated by losing vaporization heat to the refrigerant in the evaporator 18.

The compressor 100 to which a displacement control system A of a first embodiment is applied is a variable displacement compressor, and is, for example, a reciprocating swash plate compressor. The compressor 100 has a cylinder block 101. A plurality of cylinder bores 101*a* are formed in the cylinder block 101. A front housing 102 is joined to a first end of the cylinder block 101, whereas a rear housing (cylinder head) 104 is joined to a second end of the cylinder block 101 with a valve plate 103 intervening therebetween.

The cylinder block 101 and the front housing 102 define a crank chamber 105. A drive shaft 106 vertically extends through the crank chamber 105. The drive shaft 106 penetrates an annular swash plate 107 that is disposed in the crank chamber 105. The swash plate 107 is hinge-connected to a rotor 108 fixed to the drive shaft 106, with a connection 109 intervening therebetween. The swash plate 107 is therefore tiltable while moving along the drive shaft 106. In other words, angle (tilt angle) that is formed by a normal line of the swash plate 107 and an axis line of the drive shaft 106 is variable. A minimum value of the tilt angle (minimum tilt angle) is substantially zero degree.

A coil spring 110 that biases the swash plate 107 toward the minimum tilt angle is fixed to a part of the drive shaft 106, which extends between the rotor 108 and the swash plate 107. A coil spring 111 that biases the swash plate 107 toward maximum tilt angle is fixed to an opposite side of the drive shaft 106 across the swash plate 107, that is, a part of the drive shaft 106, which extends between the swash plate 107 and the cylinder block 101.

The drive shaft 106 penetrates a boss 102*a* that is projecting outside the front housing 102. Connected to an outer end of the drive shaft 106 is a driven unit of an electromagnetic clutch 200. The electromagnetic clutch 200 is interposed between an engine 500 serving as a power source and the compressor 100, and interceptably transmits power from the power source to the compressor 100.

More specifically, the electromagnetic clutch 200 has a drive unit and the driven unit. A drive rotor 202 serving as a component of the drive unit is rotatably supported to an outer side of the boss 102*a* by means of a bearing. A groove is formed in an outer circumference of the drive rotor 202. An endless drive belt 502 is fitted into the groove. The drive belt 502 is also wound around a pulley of the engine 500, and transmits the power of the engine 500 to the drive unit of the electromagnetic clutch 200.

An annular field core 203 is disposed inside the drive rotor 202. The field core 203 is supported by the front housing 102 by means of a bracket. A scroll coil for an electromagnetic clutch (solenoid coil) 204 is disposed inside the field core 203 in a state wound around a bobbin.

A friction material is fixed to an end face of the drive rotor 202. An armature plate 206 is disposed near the end face of the drive rotor 202. The armature plate 206 serves as a component of the driven unit of the electromagnetic clutch 200. An outer ring 208 that is fitted onto a back face of the armature plate 206 by means of a rivet is connected to an outer circumference of a wheel 212 through an elastic member 210. The elastic member 210 allows the armature plate 206 to be pressed against the end face of the drive rotor 202 and the friction material by using an electromagnetic force that is produced when current is applied to the electromagnetic clutch coil 204. A hub is integrally formed in the center of the wheel 212, and is spline-engaged with an outer end of the drive shaft 106.

A shaft seal device 116 is disposed inside the boss 102*a*, and seals the inside of the front housing 102 from the outside. The drive shaft 106 is rotatably supported by bearings 117, 118, 119 and 120 in radial and thrust directions. When the power from the engine 500 is transmitted to the wheel 212 of the electromagnetic clutch 200, the drive shaft 106 is rotatable in sync with rotation of the wheel 212.

A piston 130 is disposed inside the cylinder bore 101*a*. A tail projecting into the crank chamber 105 is integrally formed in the piston 130. A pair of shoes 132 is disposed in a recessed area 130*a* formed in the tail. The shoes 132 are in sliding contact with rim portions of the swash plate 107 so as to sandwich the swash plate 107. Accordingly, the piston 130 and the swash plate 107 operate in conjunction with each other through the shoes 132. The piston 130 reciprocates within the cylinder bore 101*a* in response to the rotation of the drive shaft 106.

A rear housing 104 is sectioned into a suction chamber (suction pressure region) 140 and a discharge chamber (discharge pressure region) 142. The suction chamber 140 communicates with the cylinder bore 101*a* through a suction hole 103*a* formed in a valve plate 103. The discharge chamber 142 communicates with the cylinder bore 101*a* through a discharge hole 103*b* formed in the valve plate 103. The suction hole 103*a* and the discharge 103*b* are opened and closed by using a suction valve and a discharge valve, respectively, not shown.

A muffler 150 is set to the outside of the cylinder block 101. A muffler casing 152 is jointed through a seal member, not shown, to a muffler base 101*b* that is integrally formed in the cylinder block 101. The muffler casing 152 and the muffler base 101*b* define a muffler space 154. The muffler space 154 communicates with the discharge chamber 142 through a discharge path 156 running through the rear housing 104, the valve plate 103 and the muffler base 101*b*.

A discharge port 152*a* is formed in the muffler casing 152. A check valve 250 is set in the muffler space 154 so as to disconnect between the discharge path 156 and the discharge port 152*a*. The check valve 250 keeps closed until difference between pressure on the discharge path 156 side (inlet side) and pressure on the discharge port 152*a* side (outlet side) becomes given preset differential pressure ΔP1. If the difference exceeds the preset differential pressure ΔP1, the check valve 250 is opened to allow the refrigerant to be discharged from the compressor 100 into the radiator 14.

A suction port 104*a* is formed in the rear housing 104 and opens into the suction chamber 140. A return path of the circulation path 12 is connected to the suction port 104*a*. The evaporator 18 and the suction chamber 140 communicate with each other through the suction port 104*a*.

A displacement control valve (electromagnetic control valve) 300 is received in the rear housing 104. The displacement control valve 300 is interposed in a gas passage 160. The gas passage 160 extends from the rear housing 104 to the cylinder block 101 via the valve plate 103, connecting between the discharge chamber 142 and the crank chamber 105.

The suction chamber 140 communicates with the crank chamber 105 through a gas release passage 162. The gas release passage 162 is made up of a gap between the drive shaft 106 and the bearings 119 and 120, a space 164, and a fixed orifice 103*c* formed in the valve plate 103.

The suction chamber 140 is connected to the displacement control valve 300 independently of the gas passage 160 through a pressure-sensitive passage 166 formed in the rear housing 104.

Figure 2:
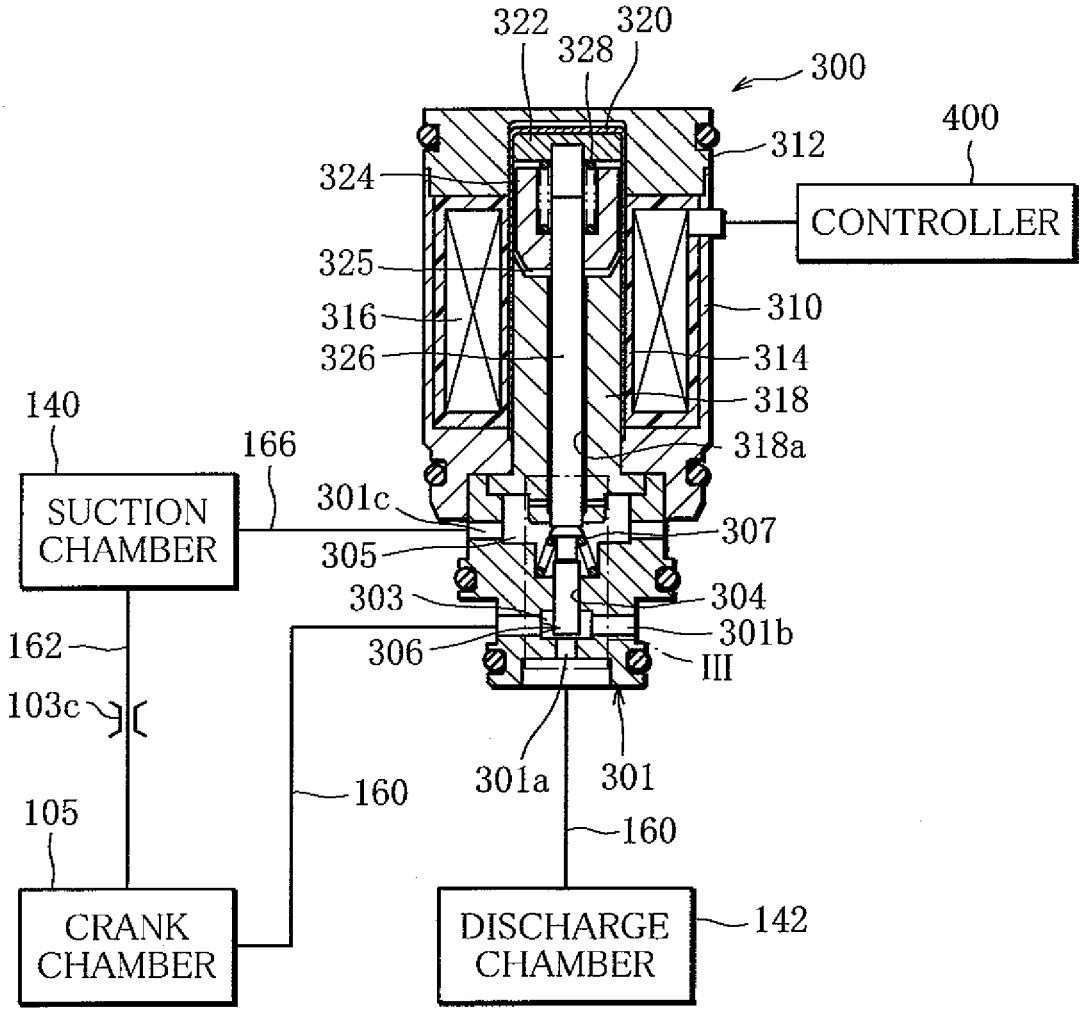
FIG. 2 is a view for explaining a connected state of a displacement control valve in the variable displacement compressor shown in FIG. 1.

To be more concrete, as illustrated in FIG. 2, the displacement control valve 300 is formed of a valve unit and a solenoid unit serving as an actuator for opening/closing the valve unit. The valve unit includes a cylindrical valve housing 301. The valve housing 301 has an inlet port (valve hole 301*a*) in a first end thereof. The valve hole 301*a* leads to the discharge chamber 192 through an upstream portion of the gas passage 160, and opens into a valve chamber 303 that is marked off in the valve housing 301.

An outlet port 301*b* extending through the valve housing 301 in a diametrical direction opens into the valve chamber 303. The valve chamber 303 thus communicates with the crank chamber 105 through the outlet port 301*b* and a downstream portion of the gas passage 160.

A first end of an insertion hole 309 opens into the valve chamber 303 on the opposite side to the valve hole 301*a*. The insertion hole 304 extends along an axis line of the valve housing 301 as with the valve hole 301*a*. A second end of the insertion hole 304 opens into a pressure-sensitive chamber 305. A pressure-sensitive port 301*c* extending through the valve housing 301 in the diametrical direction opens into the pressure-sensitive chamber 305. The pressure-sensitive chamber 305 thus communicates with the suction chamber 140 through the pressure-sensitive port 301*c* and the pressure-sensitive passage 166.

Figure 3:
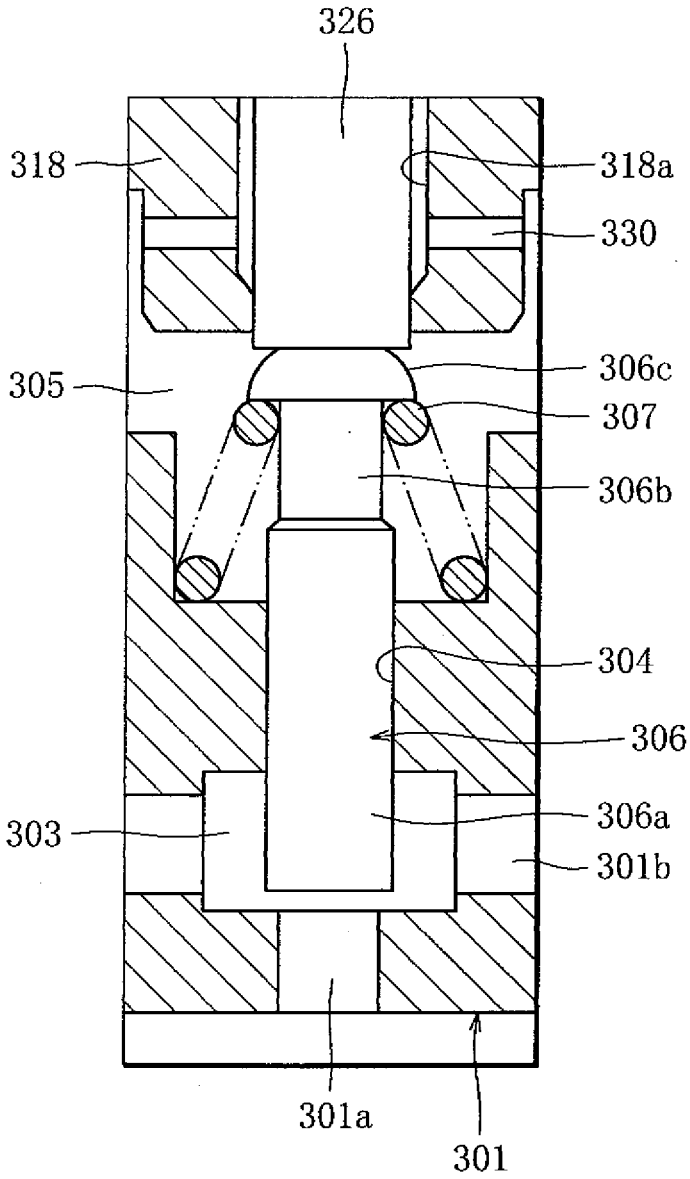
FIG. 3 is a view showing an area III of FIG. 2 in enlarged scale.

A valve body 306 is disposed in the valve housing 301. As illustrated in FIG. 3 in an enlarged scale, the valve body 306 includes a cylindrical main body 306*a*. The main body 306*a* extends from the valve chamber 303 through the insertion hole 309 to the pressure-sensitive chamber 305. The main body 306*a* is slidably supported by the insertion hole 304.

The valve body 306 has a shaft portion 306*b* that is integrally and coaxially connected to the main body 306*a*. The shaft portion 306*b* is located in the pressure-sensitive chamber 305. A head portion 306*c* with a larger diameter than the shaft portion 306*b* is integrally formed in an opposite end of the shaft portion 306*b* to the main body 306*a*. Disposed between an end wall of the pressure-sensitive chamber 305, in which the insertion hole 304 is formed, and the head portion 306*c* is a conical coil spring 307. The conical coil spring 307 biases the valve body 306 in a direction moving away from the valve hole 301*a* (valve-opening direction).

Referring to FIG. 2 again, the solenoid unit has a cylindrical solenoid housing 310. The solenoid housing 310 is coaxially connected to a second end of the valve housing 301 by press-fitting. An open end of the solenoid housing 310 is closed with an end cap 312. Received in the solenoid housing 310 is a cylindrical coil for a displacement control valve (solenoid coil) 316, which is covered with a resin member 314.

A cylindrical fixed core 318 is concentrically received in the solenoid housing 310. The fixed core 318 extends from the valve housing 301 towards the end cap 312 to reach the center of the displacement control valve coil 316. The end cap 312 side of the fixed core 318 is surrounded by a cylindrical member 320. The cylindrical member 320 has a closed end on the end cap 312 side.

A support member 322 is disposed inside the cylindrical member 320 so as to closely contact the closed end of the cylindrical member 320. Defined between the fixed core 318 and the support member 322 is a movable core-receiving space 325 that receives a cylindrical movable core 324.

The fixed core 318 has a central hole 318*a*. A first end of the central hole 318*a* opens into the movable core-receiving space 325. A solenoid rod 326 is inserted into the central hole 318*a*. The solenoid rod 326 is projecting from both ends of the fixed core 318.

The cylindrical movable core 324 is integrally fixed to a portion of the solenoid rod 326, which vertically extends through the movable core-receiving space 325. The solenoid rod 326 extends to reach the support member 322. A support member 322-side end of the solenoid rod 326 is slidably supported by a cylindrical bottomed hole of the support member 322.

The movable core 324, the fixed core 318, the solenoid housing 310 and the end cap 312 are made of magnetic material, and form a magnetic circuit. The cylindrical member 320 is made of a stainless steel-based material that is a nonmagnetic material.

A compression coil spring 328 is disposed between the movable core 324 and the support member 322. The compression coil spring 328 biases the movable core 324 in a direction moving away from the support member 322 (valve-closing direction).

However, there is a given gap secured between the movable core 324 and the fixed core 318. The movable core 324 has an external diameter that is smaller than an internal diameter of the cylindrical member 320. There is a gap secured between the movable core 324 and the cylindrical member 320.

The displacement control valve 300 has, as means for biasing the valve body 306 (biasing means), the conical coil spring 307 that constantly biases the valve body 306 in the valve-opening direction and the compression coil spring 328 that constantly biases the valve body 306 in the valve-closing direction. However, the biasing means as a whole constantly biases the valve body 306 in the valve-closing direction. To put it differently, when a biasing force of the conical coil spring 307 is f3, and that of the compression coil spring 328 is f4, the biasing force f3 is slightly smaller than the biasing force f4. The biasing means constantly biases the valve body 306 in the valve-closing direction according to difference between the biasing forces f4 and f3.

A second end of the central hole 318*a* opens into the pressure-sensitive chamber 305. Referring to FIG. 3 again, an internal diameter of the central hole 318*a* is reduced in a projecting end portion of the fixed core 318, which is projecting into the pressure-sensitive chamber 305. The pressure-sensitive chamber 305-side end of the solenoid rod 326 is slidably supported by the projecting end portion of the fixed core 318, or a diameter-reduced portion of the central hole 318*a*. The end portion of the solenoid rod 326, which is projecting into the pressure-sensitive chamber 305, is in contact with the head portion 306*c* of the valve body 306.

A communicating hole 330 is formed in a root of the projecting end portion of the fixed core 318. The pressure-sensitive chamber 305 communicates with the movable core-receiving space 325 through the communicating hole 330 and the central hole 318*a*. Accordingly, pressure of the suction chamber 140, namely, suction pressure Ps, is exerted on a back face side, or the pressure-sensitive chamber 305 side, of the valve body 306 in the valve-closing direction through the solenoid rod 326.

Connected to the displacement control valve coil 316 is a controller 400 that is set outside the compressor 100 (see FIG. 2). When control current I is supplied from the controller 400 to the displacement control valve coil 316, the solenoid unit generates electromagnetic force F(I). The electromagnetic force F(I) of the solenoid unit attracts the movable core 324 towards the fixed core 318, and acts upon the valve body 306 through the solenoid rod 326 in the valve-closing direction.

In the displacement control valve 300, an end face of the main body 306*a* of the valve body 306 faces the valve hole 301*a*. The end face of the valve body 306*a* is applied with pressure of the discharge chamber 142, or discharge pressure Pd, in the valve-opening direction. A second end of the valve body 306, or the head portion 306*c*, is located in the pressure-sensitive chamber 305. The second end of the valve body 306 is applied with the pressure of the suction chamber 140, or suction pressure Ps, in the valve-closing direction. The valve body 306 thus functions as a pressure-sensitive member that operates in response to pressure difference between the discharge pressure Pd and the suction pressure Ps.

When the valve body 306 is in a position closing the valve hole 301*a*, area of the valve body 306, on which the discharge pressure Pd is exerted through the valve hole 301*a* in the valve-opening direction, (pressure-receiving area Sv2) is equal to opening area of the valve hole 301*a*. The area of the valve body 306, to which the suction pressure Ps is exerted in the valve-closing direction, is equal to cross-sectional area Sr of the main body 306*a* supported by the insertion hole 304.

According to the present embodiment, the main body 306*a* is formed so that the pressure-receiving area Sv2 and the cross-sectional area Sr are substantially equal to each other. As a result, the valve body 306 is applied with virtually very little pressure of the valve chamber 303, or pressure of the crank chamber 105 (crank pressure Pc), in the valve-opening and closing directions.

Forces acting upon the valve body 306 are the discharge pressure Pd, the suction pressure Ps, the electromagnetic force F(I) of the solenoid unit, the biasing force f3 of the conical coil spring 307, and the biasing force f4 of the compression coil spring 328. Among these forces, the discharge pressure Pd and the biasing force f3 of the conical coil spring 307 act in the valve-opening direction. The other forces, namely, the suction pressure Ps, the electromagnetic force F(I) of the solenoid unit, and the biasing force f4 of the compression coil spring 328, act in the valve-closing direction opposite to the valve-opening direction.

The above-mentioned relationship is expressed by Formula (4) below. Formula (5) is obtained by modifying Formula (4) on the condition that Sv2=Sr. If the solenoid unit is designed so that the electromagnetic force F(I) is proportional to the control current I, and Formula (5) is modified on the condition that F(I)=A·I (A is a coefficient), Formula (6) is obtained.

$$Sv2 \cdot Pd - Sr \cdot Ps + f3 - f4 - F(I) = 0 \tag{4}$$

$$Pd - Ps = \frac{1}{Sv2} \cdot F(I) + \frac{f4 - f3}{Sv2} \tag{5}$$

$$Pd - Ps = \frac{A}{Sv2} \cdot I + \frac{f4 - f3}{Sv2} \tag{6}$$

Formula (6) shows that the difference between the discharge pressure Pd and the suction pressure Ps (Pd−Ps differential pressure ΔP) can be adjusted by the electromagnetic force F(I) of the solenoid unit, that is, the control current I supplied to the displacement control valve coil 316.

More concretely, the electromagnetic force F(I) acts upon the valve body 306 in the valve-closing direction. The Pd−Ps differential pressure ΔP can be increased by augmenting the control current I. According to such relationship, by altering the control current I, the discharge displacement is feedback-controlled so that the Pd−Ps differential pressure ΔP becomes a given value. The above-described control is also called Pd−Ps differential pressure control.

As mentioned above, the biasing force f3 of the conical coil spring 307 is set slightly smaller than the biasing force f4 of the compression coil spring 328 (f3<f4). The valve body 306 is constantly biased in the valve-closing direction according to the difference between the biasing forces f4 and f3. Consequently, when the discharge pressure Pd, the suction pressure Ps and the electromagnetic force F(I) are not exerted, the valve hole 301*a* is closed by the valve body 306.

Figure 4:
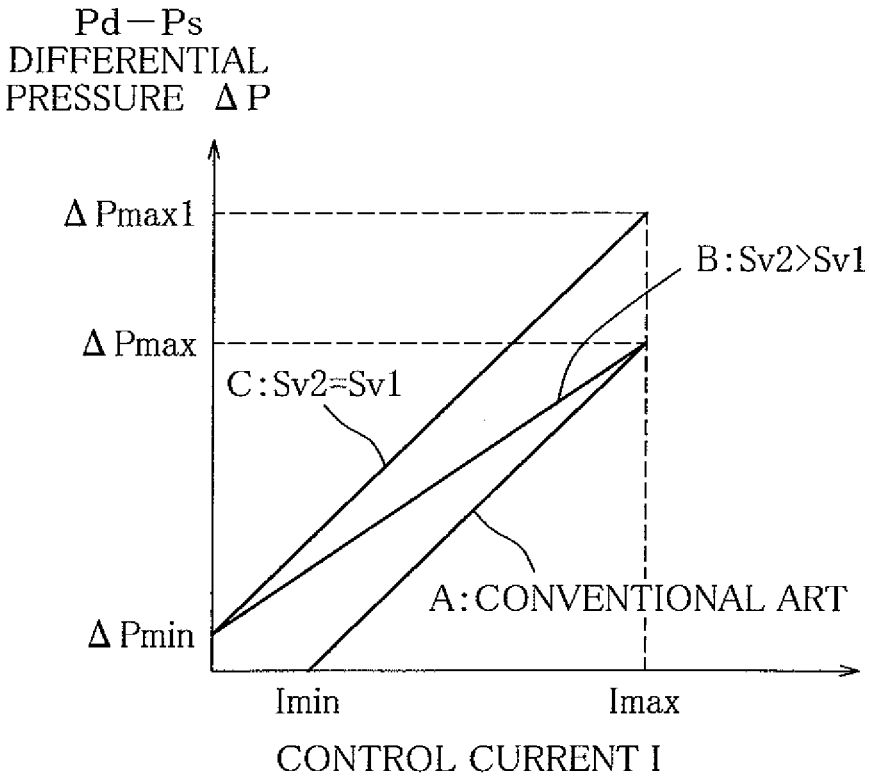
FIG. 4 is a graph showing relationship between control current I and Pd−Ps differential pressure ΔP in the displacement control valve.

As shown by a straight line B of FIG. 4, when the control current I is zero, the Pd−Ps differential pressure ΔP is a given minimum value (minimum differential pressure ΔPmin) that is larger than zero. The electromagnetic force F(I) biases the valve body 306 in the valve-closing direction as the control current I is augmented from zero, so that the Pd−Ps differential pressure ΔP becomes larger than the minimum differential pressure ΔPmin.

Characteristic of the solenoid unit of the displacement control valve 300, or the electromagnetic force F(I) in Formula (4), may be equal to characteristic of a solenoid unit of a conventional displacement control valve, or the electromagnetic force F(I) in Formula (3). The pressure-receiving area Sv2 of the valve body 306 of the displacement control valve 300 is preferably set larger than the pressure-receiving area Sv1 in a conventional displacement control valve.

A reason for this is that, if the minimum differential pressure ΔPmin is to be obtained only by adjusting the biasing force of the biasing means on condition of equal electromagnetic forces F(I) and Sv2=Sv1, relationship between the control current I and the Pd−Ps differential pressure ΔP becomes as shown by a straight line C of FIG. 4. In this case, if the displacement control valve 300 and a conventional displacement control valve are equal in maximum current Imax, maximum differential pressure ΔPmax1 reached by the displacement control valve 300 is higher than ΔPmax of conventional technology. If the pressure-receiving area Sv2 is made larger than the pressure-receiving area Sv1 of the conventional technology, the same maximum differential pressure ΔPmax can be obtained at the same maximum current Imax. For that reason, it is preferable that Sv2 and Sv1 be set so that Sv2>Sv1 is true.

If the displacement control valve 300 obtains the same maximum differential pressure ΔPmax at the same maximum current Imax as with the conventional displacement control valve, ratio of the pressure-sensitive area Sv2 to the pressure-sensitive area Sv1 is obtained by Formula (9) below. Formula (9) can be yielded from Formulae (7) and (8), and Formula (7) from Formula (3) on the basis of the straight line A of FIG. 4. Formula (8) can be yielded from Formula (5) on the basis of the straight line B of FIG. 4.

$$\frac{A}{Sv1} = \frac{\Delta P\max - 0}{I\max - I\min} \tag{7}$$

$$\frac{A}{Sv2} = \frac{\Delta P\max - \Delta P\min}{I\max - 0} \tag{8}$$

$$\frac{Sv2}{Sv1} = \frac{I\max}{I\max - I\min} \cdot \frac{\Delta P\max}{\Delta P\max - \Delta P\min} \tag{9}$$

For example, using R134a as refrigerant, if the maximum differential pressure ΔPmax is 3 MPa at a maximum current Imax of 0.8 A, and the minimum differential pressure ΔPmin is 0.1 MPa at a control current I of 0, Sv2/Sv1 equals 1.38 on the condition that the minimum current Imin of the conventional technology is 0.2 A.

Using carbon dioxide as refrigerant, if the maximum differential pressure ΔPmax is 12 MPa at a maximum current Imax of 0.8 A, and if the minimum differential pressure ΔPmin is 1 MPa at a control current I of 0, Sv2/Sv1 equals 1.45 on the condition that the minimum current Imin of the conventional technology is 0.2 A.

As stated above, if the same maximum differential pressure ΔPmax as in the conventional technology is yielded under the condition that the control current I is in a range from zero to the maximum current Imax, change in the Pd−Ps differential pressure ΔP in relation to change in the control current I, that is, an inclination of the straight line B of FIG. 4, is reduced. This stabilizes the control of the Pd−Ps differential pressure ΔP, which is conducted by adjusting the control current I.

The force acting upon the valve body 306 due to refrigerant pressure is Sv2·(Pd−Ps). Accordingly, if the pressure-receiving area Sv2 is increased more than Sv1 of the conventional technology, when the discharge pressure Pd or the suction pressure Ps is changed, a change amount of the force acting upon the valve body 306 due to refrigerant pressure is increased. This improves performance sensitivity of the valve body 306 toward a pressure change of the refrigerant, and stabilizes the displacement control.

Referring to Formula (5), the minimum differential pressure ΔPmin equals a value yielded by dividing the biasing force, with which the biasing means biases the valve body 306 in the valve-closing direction, by the pressure-sensitive area Sv2 (f4−f3)/Sv2. The minimum differential pressure ΔPmin is set in view of the following factors.

A comparative example is a displacement control valve in which the valve body 306 entirely opens the valve hole 301*a* under the condition, unlike the present embodiment, that inequality relation between the biasing force f3 of the conical coil spring 307 and the biasing force f4 of the compression coil spring 328 of the displacement control valve 300 is set so that f3−f4>0 is true, and that no current is applied to the displacement control valve coil 316.

If the displacement control valve 300 is replaced with the displacement control valve of the comparative example, and the compressor 100 is operated without applying current to the displacement control valve coil, the compressor 100 is mechanically operated in a state where the discharge displacement is minimum. The Pd−Ps differential pressure ΔP produced in this state is a minimum value (machine's minimum differential pressure ΔPr) that can be mechanically achieved by the variable displacement compressor 100. It is impossible to reduce the Pd−Ps differential pressure ΔP lower than the machine's minimum differential pressure ΔPr.

The minimum differential pressure ΔPmin is set higher than the machine's minimum differential pressure ΔPr. If the electromagnetic clutch 200 is turned ON to connect the engine 500 and the compressor 100 together, the Pd−Ps differential pressure ΔP is surely adjusted at a larger value than the minimum differential pressure ΔPmin.

If the check valve 250 is provided to the compressor 100, the minimum differential pressure ΔPmin is set higher than not only the machine's minimum differential pressure ΔPr but also the preset differential pressure ΔP1 of the check valve 250. If the electromagnetic clutch 200 is turned ON to connect the engine 500 and the compressor 100 together, the check valve 250 is opened, and the refrigerant is discharged from the compressor 100.

Figure 5:
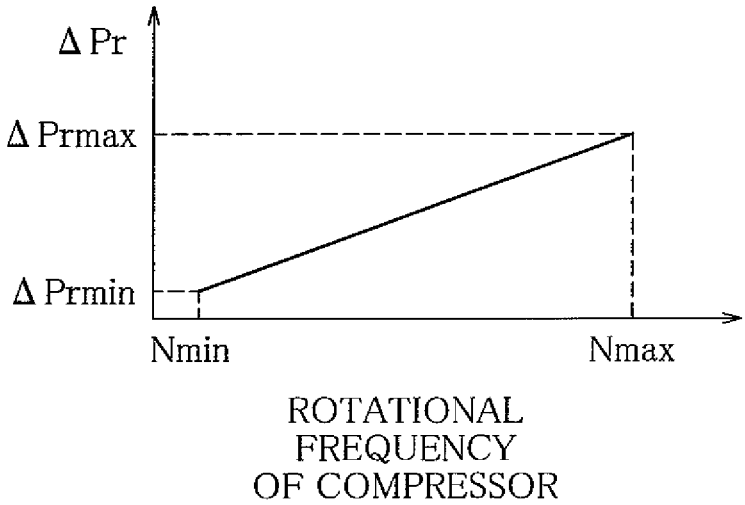
FIG. 5 is a graph showing relationship between rotational frequency of the compressor and machine's minimum differential pressure ΔPr.

As illustrated in FIG. 5, the machine's minimum differential pressure ΔPr is increased along with an increase of rotational speed of the compressor 100. Accordingly, under predicted heat load conditions, the minimum differential pressure ΔPmin may be set, for example, at a value higher than the maximum value ΔPrmax of the machine's minimum differential pressure ΔPr that is generated when the rotational speed of the compressor 100 is maximum.

Figure 6:
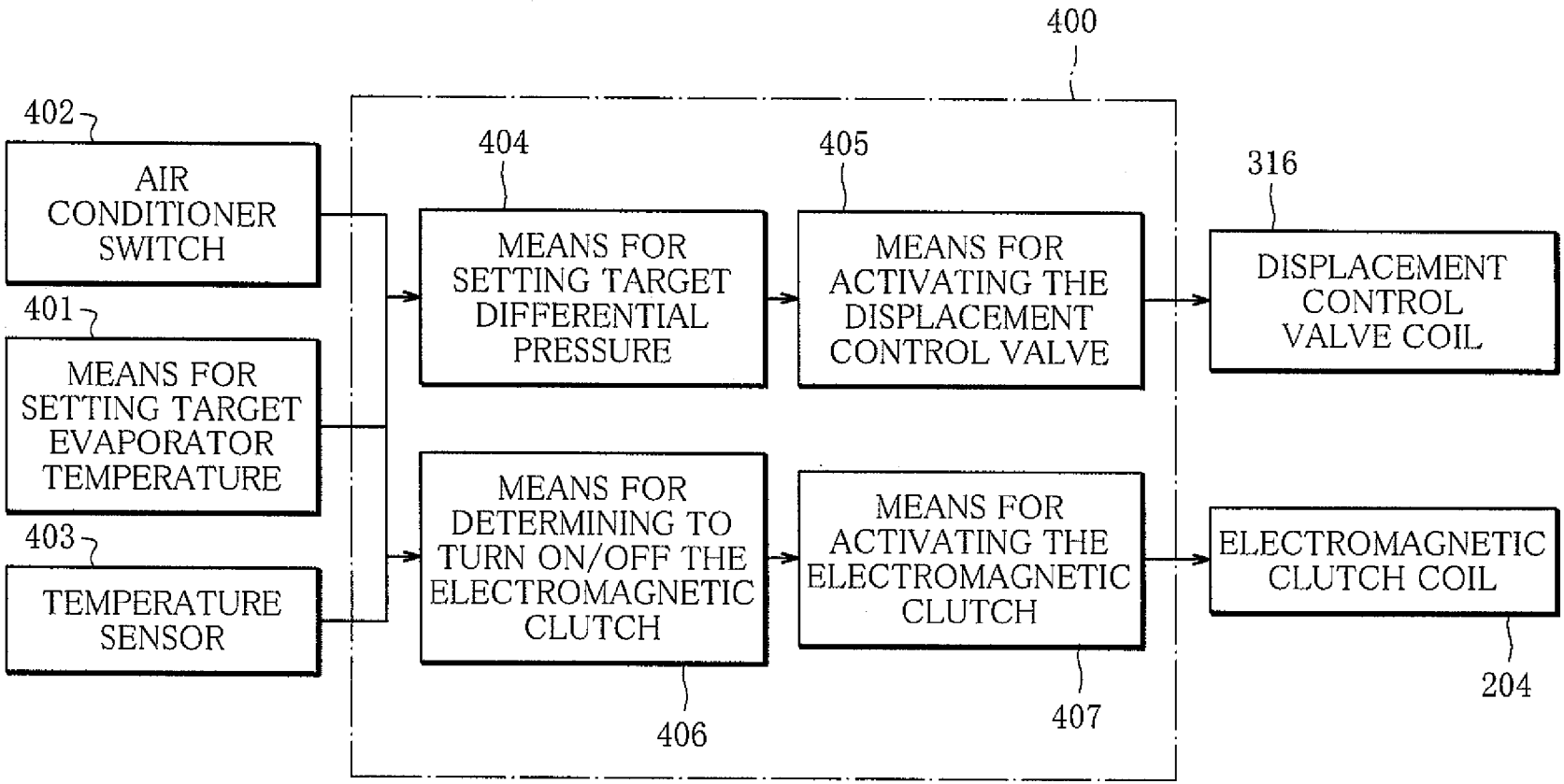
FIG. 6 is a block diagram showing a schematic configuration of a displacement control system of a variable displacement compressor of a first embodiment.

FIG. 6 is a block diagram showing a schematic configuration of the displacement control system A including the controller 400. The displacement control system A has an air conditioner switch 402, means 401 for setting target evaporator temperature, and a temperature sensor 403.

The means 401 for setting target evaporator temperature can be constructed, for example, of a part of an air conditioner ECU (electrical control unit) that controls the operation of the entire air-conditioning system. The controller 400 can be constructed of an independent ECU, but may be constructed of a part of an air conditioner ECU.

The air conditioner switch 402 is operated by an occupant. By turning on or off the air conditioner switch 402, it is possible to switch the variable displacement compressor 100 from a non-operated state to an operated state or from the operated state to the non-operated state.

The means 401 for setting target evaporator temperature is means for setting a target refrigeration state of the evaporator 18. Based upon various pieces of external information including the setting of vehicle interior temperature, which is set by the occupant, target evaporator-outlet air temperature Tes is set. The target evaporator-outlet air temperature Tes is a target of the discharge displacement control of the compressor 100 and is a target value of air temperature at an outlet of the evaporator 18 (evaporator-outlet air temperature) Te.

A temperature sensor 403 is one of external-information detecting means and detects the evaporator-outlet air temperature Te to detect a refrigeration state of the evaporator 18. The temperature sensor 403 is placed at the outlet of the evaporator 18 located in an air circuit (see FIG. 1).

The controller 400 has means 404 for setting target differential pressure, means 405 for driving the displacement control valve, means 406 for determining to turn on/off the electromagnetic clutch, and means 407 for driving the electromagnetic clutch.

The state of the air conditioner switch 402, the target evaporator-outlet air temperature Tes that is set by the means 401 for setting target evaporator temperature, and the evaporator-outlet air temperature Te that is detected by the temperature sensor 403 are inputted into the means 404 for setting target differential pressure. Based upon the above information, the means 404 for setting target differential pressure sets the target differential pressure ΔPt. The target differential pressure ΔPt is a target value of the Pd−Ps differential pressure ΔP that is difference between the discharge pressure Pd and the suction pressure Ps. As is clear from Formula (6), the Pd−Ps differential pressure ΔP is determined by the control current I supplied to the displacement control valve coil 316. To set the target differential pressure ΔPt is to set the control current I to be supplied to the displacement control valve coil 316. To put it differently, it can be said that the means 404 for setting target differential pressure sets the control current I.

The means 405 for driving the displacement control valve supplies the control current I that is set by the means 404 for setting target differential pressure to the displacement control valve coil 316, and thus drives the displacement control valve 300. The control current I is adjusted by altering a duty ratio, for example, with PWM (pulse width modulation) of given drive frequency (for example, ranging from 400 Hz to 500 Hz).

In other words, the means 404 for setting target differential pressure and the means 405 for driving the displacement control valve form means for adjusting current for the displacement control valve, which adjusts the control current I supplied to the displacement control valve coil 316 or a parameter associated with the control current I, on the basis of the external information detected by the external-information detecting means.

The means 406 for determining to turn on/off an electromagnetic clutch makes a determination as to whether to turn on or off the electromagnetic clutch 200 according to the state of the air conditioner switch 402, the target evaporator-outlet air temperature Tes that is set by the means 401 for setting target evaporator temperature, and the evaporator-outlet air temperature Te that is detected by the temperature sensor 403. The means 406 for determining to turn on/off an electromagnetic clutch may determine to turn on the electromagnetic clutch 200 at least when the air conditioner switch 402 is ON.

When the means 406 for determining to turn on/off an electromagnetic clutch determines to turn on the electromagnetic clutch 200, the means 406 outputs an electromagnetic clutch operation signal to the means 407 for driving the electromagnetic clutch. The means 407 for driving the electromagnetic clutch, for example, includes an electromagnetic relay that is provided separately from the ECU. When the electromagnetic clutch operation signal is inputted into the electromagnetic relay, current is supplied from the power source to the electromagnetic clutch coil 204. As a result, the electromagnetic clutch 200 is excited, and the engine 500 and the compressor 100 are connected together.

In other words, the means 406 for determining to turn on/off the electromagnetic clutch and the means 407 for driving the electromagnetic clutch form the means for adjusting current for the electromagnetic clutch, which adjusts the current supplied to the electromagnetic clutch coil 204, on the basis of the external information detected by the external-information detecting means.

The usage (operation) of the displacement control system A will be described below.

When the air conditioner switch 402 is OFF, no current is supplied to the electromagnetic clutch coil 204. The armature plate 206 is therefore not pressed against the end face of the rotor 202, and the power from the engine 500 is not transmitted to the drive shaft 106. In short, the variable displacement compressor 100 is brought into a shutdown state. When the air conditioner switch 402 is OFF, the displacement control valve coil 316 of the displacement control valve 300 is not supplied with current, either.

When the air conditioner switch 402 is turned ON, the means 406 for determining to turn on/off the electromagnetic clutch produces and outputs the electromagnetic clutch operation signal to the means 407 for driving the electromagnetic clutch. The electromagnetic relay of the means 407 for driving the electromagnetic clutch connects between the electromagnetic clutch coil 204 and the power source according to the electromagnetic clutch operation signal. The electromagnetic clutch coil 204 is then supplied with current.

As a result, the electromagnetic clutch 200 is excited and brought into the ON state, and the armature plate 206 is pressed against the end face of the rotor 202. At this point of time, the rotor 202 is rotated by the drive belt 502. The rotation of the rotor 202 is transmitted to the armature plate 206 by a frictional force. In short, power is transmitted from the engine 500 to the compressor 100.

Once the power is transmitted from the engine 500, the compressor 100 is activated from the non-operated state to the operated state. The compressor 100 in operation sucks the refrigerant, compresses the sucked refrigerant, and discharges the compressed refrigerant. The refrigerant then circulates through the circulation path 12, thereby cooling or dehumidifying the vehicle interior.

Although the discharge displacement of the compressor 100 is variable, an air-conditioning control mode may be applied as a basic control mode of the discharge displacement.

In the air-conditioning control mode, the means 404 for setting target differential pressure sets the target differential pressure ΔPt that is a control target so that the actual evaporator-outlet air temperature Te detected by the temperature sensor 403 moves closer to the target temperature Tes that is set by the means 401 for setting target evaporator temperature. In other words, the control current I to be supplied to the displacement control valve coil 316 is calculated. The control current I can be calculated, for example, by means of an arithmetic expression for PI control. In result, the Pd−Ps differential pressure ΔP, or discharge displacement, is controlled so that the actual evaporator-outlet air temperature Te detected by the temperature sensor 403 moves closer to the target evaporator-outlet air temperature Tes that is set by the means 401 for setting target evaporator temperature.

To be specific, the target differential pressure ΔPt or the control current I is adjusted to decrease deviation ΔT (=Tes−Te) between the target evaporator-outlet air temperature Tes and the evaporator-outlet air temperature Te, thereby adjusting a valve-opening degree of the displacement control valve 300.

When the valve-opening degree of the displacement control valve 300 is reduced, the communication between the discharge chamber 142 and the crank chamber 105 through the gas passage 160 is limited by the valve body 306, thereby reducing an introduction amount of the refrigerant (discharge gas) of the discharge chamber 142 into the crank chamber 105. Although limited by the fixed orifice 103*c*, the refrigerant in the crank chamber 105 flows from the crank chamber 105 through the gas release passage 166 into the suction chamber 140. For this reason, when the introduction amount is reduced, the crank pressure Pc is decreased. Consequently, the tilt angle of the swash plate 107 is enlarged, and the discharge displacement is increased.

When the valve-opening degree of the displacement control valve 300 is increased, the limitation on communication between the discharge chamber 142 and the crank chamber 105 is reduced, and the introduction amount of the discharge gas into the crank chamber 105 is increased. This increases the crank pressure Pc, and narrows the tilt angle of the swash plate 107, thereby decreasing the discharge displacement.

As a preferable control mode of the discharge displacement, an actuation control mode may be further applied. The activation control mode is carried out for a given time period after the activation of the compressor 100. The air-conditioning control mode can be carried out after the activation control mode.

Figure 7:
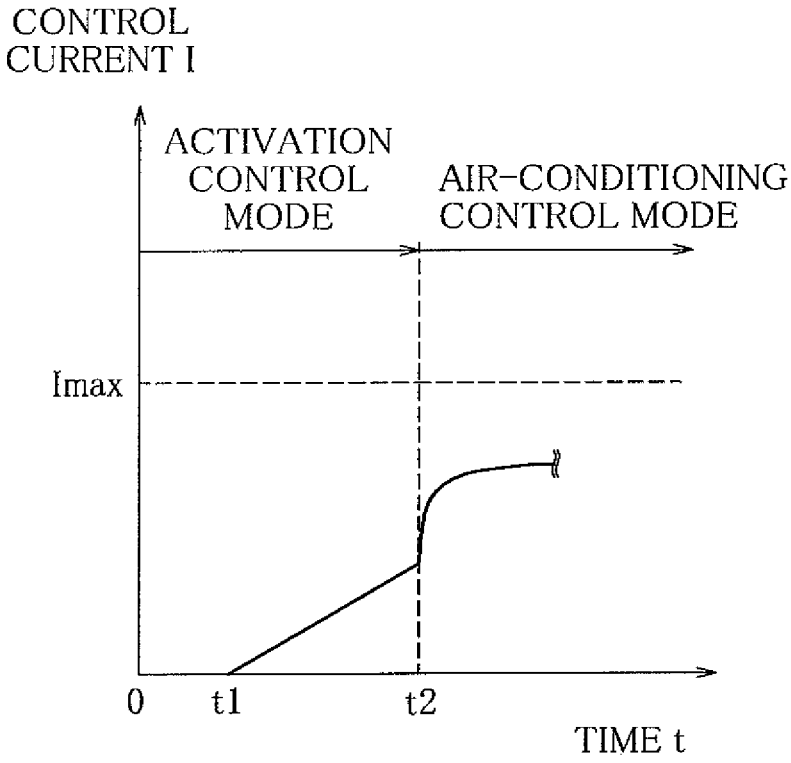
FIG. 7 is a graph showing one example of temporal change in the control current that is supplied to the displacement control valve coil by the displacement control system shown in FIG. 6.

More concretely, according to the activation control mode, as shown in FIG. 7, when the electromagnetic clutch 200 is turned ON (t=0), that is, when the compressor 100 comes into operation, the control current I is set at zero. The control current I is maintained at zero after the activation of the compressor 100 until a given time point t1. The target differential pressure ΔPt or the control current I is gradually increased after the given time point t1 until a given time point t2. The discharge displacement is accordingly increased by degree. The air-conditioning control mode is carried out from the given time point t2.

In the activation control mode, if the variable displacement compressor 100 is operated at given rotational speed while the control current I is zero, the displacement control valve 300 is opened by such valve-opening degree that the Pd−Ps differential pressure ΔP becomes the minimum differential pressure ΔPmin. In fact, the discharge displacement is autonomously controlled to maintain the minimum differential pressure ΔPmin.

Since the minimum differential pressure ΔPmin is set higher than the machine's minimum differential pressure ΔPr and the preset differential pressure ΔP1 of the check valve 250, even if the control current I is zero, the check valve 250 is opened to allow the refrigerant to be discharged from the compressor 100 to the radiator 14. When the control current I is zero, and the minimum differential pressure ΔPmin is maintained, the discharge displacement of the compressor 100 becomes minimum within a control range.

In the displacement control system A, if the control current I is supplied to the displacement control valve coil 316 even by a small amount, the electromagnetic force F(I) is produced in the solenoid unit, and the Pd−Ps differential pressure ΔP is adjusted by the electromagnetic force F(I). Consequently, even a small amount of the control current I is not wastefully consumed, and is effectively used for the displacement control.

The control current I is effectively used for the displacement control in a range from the vicinity of zero to the maximum value. This makes it possible to lower a ratio of change amount of the Pd−Ps differential pressure ΔP to change amount of the control current I. As a result, it is also possible to reduce dispersion of the Pd−Ps differential pressure ΔP when the control current I is adjusted. Consequently, the stability of the displacement control is enhanced.

Since the control current I is effectively used for the displacement control in a range of the vicinity of zero to the maximum value, it is possible to increase the pressure-receiving area Sv2 in which the valve body 306 receives the discharge pressure Pd and the suction pressure Ps. This improves the performance sensitivity of the valve body 306 toward a change in the Pd−Ps differential pressure ΔP, and enhances the stability of the displacement control.

With the displacement control system A, the refrigerant circulates through the circulation path 12 even when current is not supplied to the displacement control valve coil 316. Even if the control current I supplied to the displacement control valve coil 316 is gradually reduced, the refrigerant circulation is not suddenly stopped. With this displacement control system, therefore, the displacement control is stable even when the control current I is in the vicinity of the minimum value.

With the displacement control system A, if the activation control mode is employed, the control current I is not supplied to the displacement control valve coil 316 when the compressor 100 and the engine 500 are connected by the electromagnetic clutch 200. For that reason, the compressor 100 is activated at a small amount of discharge displacement, and the activation load of the compressor 100 is small. The reliability of the compressor 100 and the electromagnetic clutch 200 is thus improved.

Since the discharge displacement is gradually increased from a small amount by employing the activation control mode, a sharp rise of the discharge pressure Pd and an abrupt increase of drive load of the compressor 100 are prevented. With this displacement control system, therefore, the discharge displacement is smoothly controlled for a time period in which the compressor 100 is activated and then comes into normal operation (air-conditioning control mode).

Since the displacement control system A adjusts the control current I supplied to the displacement control valve coil 316 according to the target differential pressure ΔPt that is the target value of the Pd−Ps differential pressure ΔP, the control range of the discharge displacement is wide. On that basis, the control current I is effectively used for the displacement control in a range from the vicinity of zero to the maximum value, so that the entire region of wide control range is used with effect.

According to the displacement control system A, the variable displacement compressor 100 is of a reciprocating type with a swash plate element. A mechanical variable range of the discharge displacement is wide, and this wide variable range is effectively used.

The present invention is not limited to the first embodiment described above, and may be modified in various ways. A displacement control system B of a second embodiment will be described below.

Figure 8:
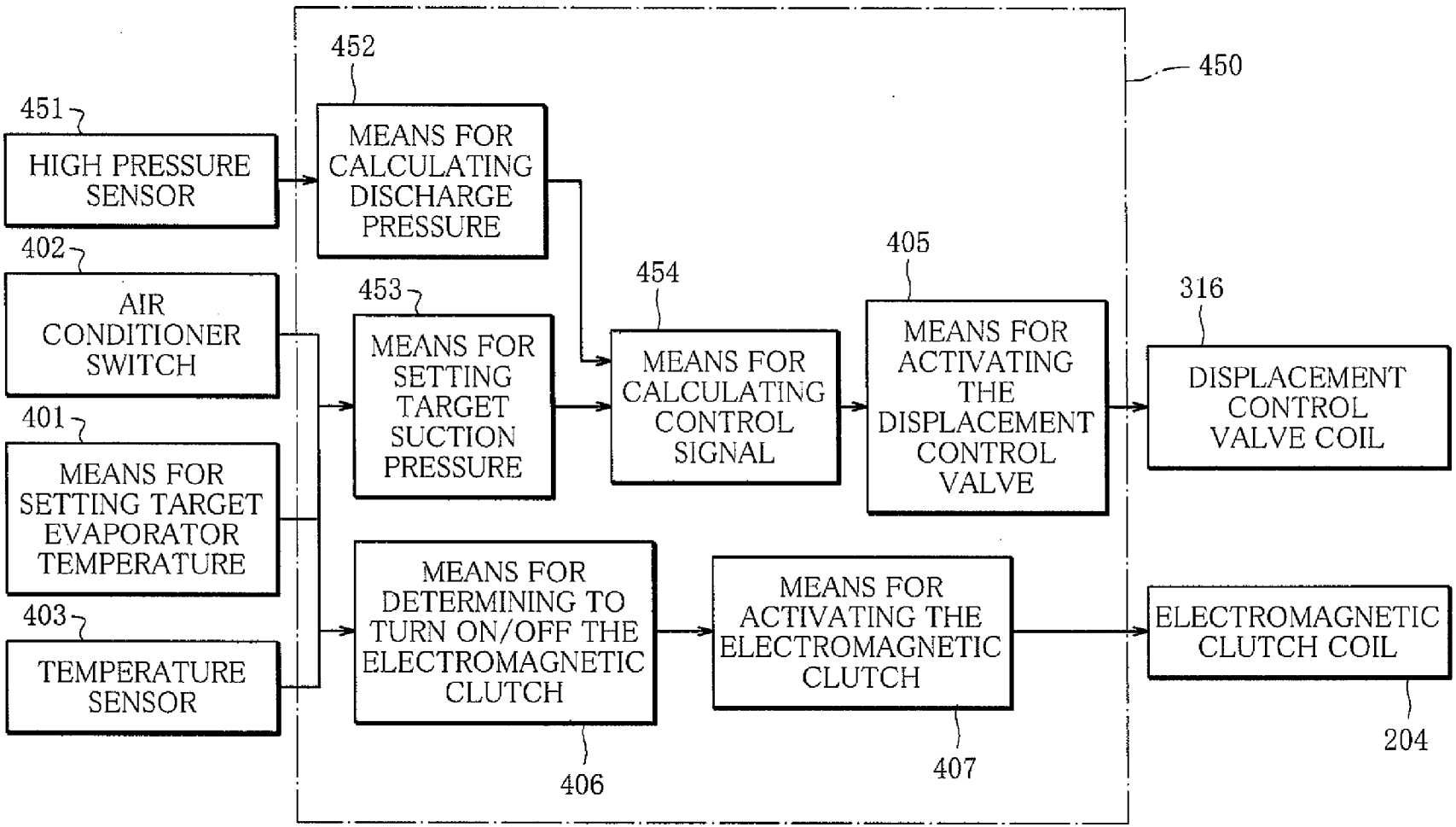
FIG. 8 is a block diagram showing a schematic configuration of a displacement control system of a variable displacement compressor of a second embodiment.

The displacement control system B can be applied to the compressor 100 and the displacement control valve 300. However, as shown in FIG. 8, the displacement control system B differs from the displacement control system A in some points. The displacement control system B will be described below with focus on differences from the displacement control system A.

The displacement control system B has discharge-pressure detecting means as external-information detecting means. The discharge-pressure detecting means is formed of a high pressure sensor 451 and discharge-pressure calculating means 452. The high pressure sensor 451 is placed, for example, on an inlet side of the radiator 14 (see FIG. 1), and detects the pressure of the refrigerant at the inlet of the radiator 14 as high pressure Ph. The high pressure sensor 451 may be in a high pressure region of the refrigeration cycle 10 extending from the discharge chamber 142 to the inlet of the expansion device 16.

The discharge-pressure calculating means 452 calculates the discharge pressure Pd by the means of the following formula on the basis of the differential pressure ΔPd between an installed position of the high pressure sensor 451 and the discharge chamber 142.

$$Pd=Ph+\Delta Pd$$

The high pressure sensor 451 also functions as heat-load detecting means for calculating an initial value of target suction pressure Pss.

A controller 450 has means 453 for setting target suction pressure and means 454 for calculating a control signal instead of the means 404 for setting target differential pressure.

The means 453 for setting target suction pressure sets the target suction pressure Pss. The target suction pressure Pss is a target value of the suction pressure Ps that is a control target. The means 453 for setting target suction pressure properly sets an initial value of the target suction pressure Pss when there is a command to activate the compressor 100. Preferably, when the compressor 100 is to be activated, the means 453 for setting target suction pressure sets the initial value of the target suction pressure Pss on the basis of heat load information. The high pressure Ph maybe used as the heat load information. To be concrete, the initial value of the target suction pressure Pss is calculated by means of the following formula.

$$Pss=Ph-\Delta P3$$

When the check valve 250 is closed, Ph=Ps is true. The initial value of the target suction pressure Pss is set at a value that is slightly lower than the high pressure Ph by subtracting a given value ΔP3.

After setting the initial value of the target suction pressure Pss, the means 453 for setting target suction pressure can set the target suction pressure Pss according to target evaporator-outlet air temperature Tes that is set by the means 401 for setting target evaporator temperature and evaporator-outlet air temperature Te that is detected by the temperature sensor 403. To put it differently, the initial value is corrected, for example, by means of an arithmetic expression for PI control so that the evaporator-outlet air temperature Te moves closer to the target evaporator-outlet air temperature Tes, and the air-conditioning control mode is then carried out.

Preferably, the means 453 for setting target suction pressure sets and maintains the target suction pressure Pss as the activation control mode for a given time period after the activation of the compressor 100. In the activation control mode, the target suction pressure Pss is decreased by degree after the setting of the initial value of the target suction pressure Pss. After the activation control mode is finished, the target suction pressure Pss is set as the air-conditioning control mode according to the target evaporator-outlet air temperature Tes that is set by the means 401 for setting target evaporator temperature and the evaporator-outlet air temperature Te that is detected by the temperature sensor 403.

The means 454 for calculating a control signal calculates the control current I according to the discharge pressure Pd that is detected by the discharge-pressure detecting means and the target suction pressure Pss that is set by the means 453 for setting target suction pressure.

More specifically, the control current I is calculated by assigning the target suction pressure Pss and the discharge pressure Pd to Formula (10) below. Formula (10) is yielded by modifying Formula (6) mentioned above.

$$I=\frac{Sv2}{A}\cdot(Pd-Ps)-\frac{f4-f3}{A} \tag{10}$$

The target suction pressure Pss is assigned to the suction pressure Ps in Formula (10).

The control current I calculated by means of Formula (10) or a duty ratio corresponding to the control current I is inputted into the means 405 for driving the displacement control valve as a discharge displacement control signal.

Figure 9:
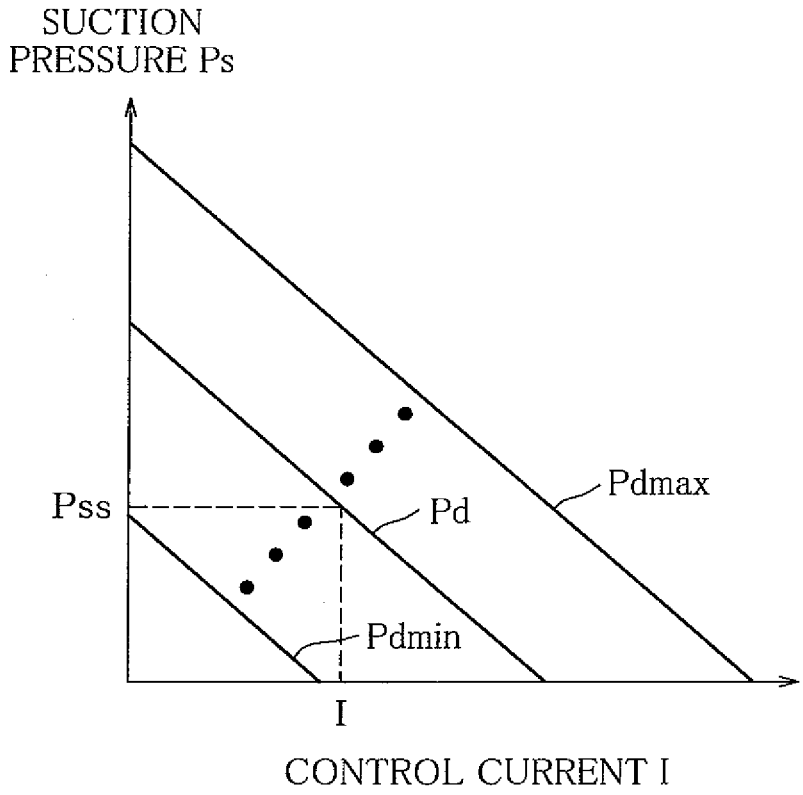
FIG. 9 is a graph showing relationship among control current, target suction pressure and discharge pressure in the displacement control system shown in FIG. 8.

In the activation control mode and the air-conditioning control mode, the discharge displacement of the compressor 100 is controlled so that the suction pressure Ps moves closer to the target suction pressure Pss by adjusting the control current I supplied to the displacement control valve coil 316 of the displacement control valve 300. This control is based upon such relationship that the suction pressure Ps is determined once the discharge pressure Pd and the control current I are determined. The performance characteristic of the displacement control valve 300 is shown by Formula (10) and FIG. 9.

The displacement control system B adjusts the control current I supplied to the displacement control valve coil 316 according to the discharge pressure Pd and the target suction pressure Pss, and thus has a wide control range of the discharge displacement. On that basis, the control current I is effectively used for the displacement control in a range from the vicinity of zero to the maximum value, so that the entire region of the wide control range is used with effect.

The first embodiment sets the minimum differential pressure ΔPmin yielded without supplying current the displacement control valve coil 316 to be higher than the machine's minimum differential pressure ΔPr. However, the minimum differential pressure ΔPmin may be determined from the point of view of design.

For example, the machine's minimum differential pressure ΔPr and the minimum differential pressure ΔPmin are set so that ΔPr<ΔPmin is true in a frequently-used part among the operation region of the variable displacement compressor 100, but may be set so that ΔPr≧Pmin is true in a less-used operation region. By thus setting ΔPr and ΔPmin, the control range of the Pd−Ps differential pressure ΔP, which can be varied by conduction control of the displacement control valve coil 316, is enlarged. It is then almost unnecessary to switch on and off the electromagnetic clutch 200.

If the minimum differential pressure ΔPmin is set much higher than the machine's minimum differential pressure ΔPr, it is possible to further narrow the control range of the Pd−Ps differential pressure ΔP, which can be varied by the conduction control of the displacement control valve coil 316. Accordingly, the pressure-sensitive area Sv2 can be enlarged. This improves the performance sensitivity of the valve body 306 toward pressure fluctuation, and enhances the stability of the control in a medium/high heat load region where the Pd–Ps differential pressure control can be conducted.

In this case, however, the discharge displacement of the compressor 100 is increased when the electromagnetic clutch 200 is ON, and the control current I is zero. Especially in a low heat load region, there is a disadvantage that the electromagnetic clutch 200 has to be turned on and off more frequently to prevent the evaporator 18 from being frozen.

Although the displacement control valve 300 of the first and second embodiments includes the valve body 306 and the solenoid rod 326 as individual bodies, the valve body and the solenoid rod may be formed into one body.

The displacement control valve 300 has the compression coil spring 328 and the conical coil spring 307 as biasing means. However, the biasing means is not limited to them as long as it is capable of constantly biasing the valve body 306 in the valve-closing direction. In other words, an elastic body used for the biasing means does not have to be a compression coil spring, and the number of elastic bodies is not limited to two. For example, regarding the displacement control valve 300, it is possible to omit the conical coil spring 307 or add another elastic body.

The valve body 306 of the displacement control valve 300 is designed to receive the discharge pressure Pd and the suction pressure Ps. However, the valve body 306 may be applied with crank pressure Pc.

Furthermore, the displacement control valve 300 may include a small bellows that separates the inside of the displacement control valve 300. In this case, for example, the valve body 306 is connected to one end of the bellows from the outside, and the discharge pressure Pd is applied to an exterior side of the bellows. At the same time, the suction pressure Ps is applied to an interior side of the bellows, and the solenoid rod 326 is connected to the one end of the bellows from the inside.

In the activation control mode of the displacement control system A of the first embodiment, as shown in FIG. 7, the control current I is increased proportionally to time. In the activation control mode, however, the control current I may be non-linearly increased as long as it is gradually increased.

Likewise, in the activation control mode of the displacement control system B of the second embodiment, it is only necessary to reduce the target suction pressure Pss by degree. The target suction pressure Pss therefore may be non-linearly decreased.

According to the second embodiment, the high pressure sensor 451 is disposed on the inlet side of the radiator 14. It is also possible, however, to dispose the high pressure sensor 451, for example, in the compressor 100, and thus directly detect the discharge pressure Pd in the discharge chamber 142. In this case, since the discharge chamber 142 is located upstream of the check valve 250, the high pressure sensor 451 can directly detect the discharge pressure Pd all the time. On the other hand, the high pressure sensor 451 is not capable of directly detecting the suction pressure Ps. On this account, when the initial value of the target suction pressure Pss is to be calculated, a value yielded by subtracting ΔP3 that is slightly higher than the preset differential pressure ΔP1 of the check valve 250 from the discharge pressure Pd may be used as the initial value of the target suction pressure Pss.

Although the compressor 100 is of a swash plate-type, the compressor 100 may be of an oscillating plate-type, vane-type or scroll-type. Furthermore, the compressor 100 may be a variable displacement compressor that is driven by an electric motor. In short, the compressor 100 only needs to be a variable displacement compressor that activates a variable displacement mechanism by altering the pressure of a control pressure chamber. In the case of the reciprocating variable displacement compressor with a swash or oscillating plate serving as a swash plate element of a swash plate-type and an oscillating plate-type, the pressure of the control pressure chamber means the pressure of the crank chamber.

According to the first and second embodiments, the fixed orifice 103*c* is interposed in the gas release passage 162. It is also possible to dispose a flow-rate variable throttle or a valve that is adjustable in opening degree.

The first and second embodiments may use a new refrigerant other than R134a and carbon dioxide.

The displacement control system for a variable displacement compressor according to the invention is applicable to all air-conditioning systems including room air-conditioning systems other than vehicle air-conditioning systems.

| Reference Marks | |
|---|---|
| 100 | variable displacement compressor |
| 200 | electromagnetic clutch |
| 300 | displacement control valve |
| 306 | valve body |
| 316 | displacement control valve coil |
| 401 | means for setting target evaporator temperature |
| 402 | air conditioner switch |
| 403 | temperature sensor (external-information detecting means) |
| 404 | means for setting target differential pressure (current-adjusting means) |
| 405 | means for driving the displacement control valve (current-adjusting means) |
| 451 | high pressure sensor (external-information detecting means) |
| 452 | means for calculating discharge pressure (external-information detecting means) |
| 453 | means for setting target suction pressure (current-adjusting means) |
| 454 | means for calculating a control signal (current-adjusting means) |

The invention claimed is:

1. A displacement control system for a variable displacement compressor, which is interposed in a circulation path circulating a refrigerant therethrough, together with a radiator, an expansion device, and an evaporator to configure a refrigeration cycle, and changes displacement according to a change in control pressure, comprising:

an electromagnetic clutch that includes a coil and connects between the compressor and a power source when the coil is supplied with current;

a displacement control valve including a valve body that is applied with pressure of a discharge pressure region of the variable displacement compressor and applied with pressure of a suction pressure region of the variable displacement compressor and an electromagnetic force of a solenoid unit in an opposite direction to the pressure of the discharge pressure region, and biasing means that biases the valve body in the same direction as the electromagnetic force, and changes the control pressure by operating the valve body;

external-information detecting means for detecting at least one piece of external information;

means for adjusting current for an electromagnetic clutch, which adjusts current supplied to the coil of the electromagnetic clutch according to the external information detected by the external-information detecting means; and means for adjusting current for the displacement control valve, which adjusts current supplied to a coil of the solenoid unit according to the external information detected by the external-information detecting means.

2. The displacement control system for a variable displacement compressor according to claim 1, wherein:

when current is supplied to the coil of the electromagnetic clutch and not to the coil of the solenoid unit of the displacement control valve, discharge displacement of the variable displacement compressor is greater than minimum discharge displacement of the variable displacement compressor, which is mechanically defined.

3. The displacement control system for a variable displacement compressor according to claim 1, wherein:

when the current supply to the coil of the electromagnetic clutch and to the coil of the solenoid unit of the displacement control valve is started, current is supplied to the coil of the solenoid unit of the displacement control valve after being supplied to the coil of the electromagnetic clutch.

4. The displacement control system for a variable displacement compressor according to claim 3, wherein:

the current supplied to the coil of the solenoid unit of the displacement control valve is gradually increased from a time point when the current supply is started.

5. The displacement control system for a variable displacement compressor according to claim 1, wherein:

the external-information detecting means includes discharge-pressure detecting means that detects the pressure of the discharge pressure region; and the means for adjusting current for the displacement control valve includes means for setting target suction pressure, which sets target suction pressure that is a target value of the pressure of the suction pressure region on the basis of the external information detected by the external-information detecting means, and adjusts current supplied to the coil according to the pressure of the discharge pressure region, which is detected by the discharge-pressure detecting means, and the target suction pressure that is set by the means for setting target suction pressure.

6. The displacement control system for a variable displacement compressor according to claim 1, wherein:

the means for adjusting current for the displacement control valve includes a means for setting target value of difference between the pressure of the discharge pressure region and the pressure of the suction pressure region on the basis of the external information detected by the external-information detecting means, and adjusts current supplied to a solenoid according to the target differential pressure that is set by the means for setting target differential pressure.

7. The displacement control system for a variable displacement compressor according to claim 1, wherein:

the variable displacement compressor including:

a housing that is sectioned into the discharge pressure region, a crank chamber, the suction pressure region and a cylinder bore;

a piston that is disposed in the cylinder bore;

a drive shaft that is rotatably supported within the housing' a conversion mechanism including a tiltable swash plate element that converts the rotation of the drive shaft into a reciprocating motion of the piston;

a gas passage that connects the discharge chamber and the crank member to each other; and a gas release passage that connects the crank chamber and the suction chamber to each other, wherein:

the displacement control valve is interposed in the gas passage.

* * * * *